US006944590B2

(12) United States Patent
Deng et al.

(10) Patent No.: US 6,944,590 B2
(45) Date of Patent: Sep. 13, 2005

(54) METHOD OF ITERATIVE NOISE ESTIMATION IN A RECURSIVE FRAMEWORK

(75) Inventors: Li Deng, Redmond, WA (US); James G. Droppo, Duvall, WA (US); Alejandro Acero, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 715 days.

(21) Appl. No.: 10/116,792

(22) Filed: Apr. 5, 2002

(65) Prior Publication Data

US 2003/0191637 A1 Oct. 9, 2003

(51) Int. Cl.[7] ..... G10L 21/02
(52) U.S. Cl. ..... 704/228; 704/226
(58) Field of Search ..... 704/226, 228

(56) References Cited

U.S. PATENT DOCUMENTS 4,918,735 A * 4/1990 Morito et al. ..... 704/233
5,604,839 A 2/1997 Acero et al. ..... 395/2.43
6,778,954 B1 * 8/2004 Kim et al. ..... 704/226

OTHER PUBLICATIONS

U.S. Appl. No. 10/117,142, filed Apr. 5, 2002, James G.Droppo et al.

U.S. Appl. No. 09/688,764, filed Oct. 16, 2000, Li Deng et al.

U.S. Appl. No. 09/688,950, filed Oct. 16, 2000, Li Deng et al.

"HMM Adaptation Using Vector Taylor Series for Noisy Speech Recognition," Alex Acero, et al., Proc. ICSLP, vol. 3, 2000, pp 869–872.

"Sequential Noise Estimation with Optimal Forgetting for Robust Speech Recognition,", Mohomed Afify, et al., Proc. ICASSP, vol. 1, 2001, pp 229–232.

"High–Performance Robust Speech Recognition Using Stereo Training Data," Li Deng, et al., Proc. ICASSP, vol. 1, 2001, pp 301–304.

"ALGONQUIN: Iterating Laplace's Method to Remove Multiple Types of Acoustic Distortion for Robust Speech Recognition," Brendan J. Frey, et al., Proc. Eurospeech, Sep. 2001, Aalborg, Denmark.

"Nonstationary Environment Compensation Based on Sequential Estimation," Nam Soo Kim, IEEE Signal Processing Letters, vol. 5, 1998, pp 57–60.

"On–line Estimation of Hidden Markov Model Parameters Based on the Kullback–Leibler Information Measure," Vikram Krishnamurthy, et al., IEEE Trans. Sig. Proc., vol. 41, 1993, pp 2557–2573.

"A Vector Taylor Series Approach for Environment–Independent Speech Recognition," Pedro J. Moreno, ICASSP, vol. 1, 1996, pp 733–736.

"Recursive Parameter Estimation Using Incomplete Data," D.M. Titterington, J. J. Royal Stat. Soc., vol. 46(B), 1984, pp 257–267.

(Continued)

*Primary Examiner*—Tālivaldis Ivars Šmits
*Assistant Examiner*—Myriam Pierre
(74) *Attorney, Agent, or Firm*—Theodore M. Magee; Westman, Champlin & Kelly, P.A.

(57) ABSTRACT

A method and apparatus estimate additive noise in a noisy signal using an iterative technique within a recursive framework. In particular, the noisy signal is divided into frames and the noise in each frame is determined based on the noise in another frame and the noise determined in a previous iteration for the current frame. In one particular embodiment, the noise found in a previous iteration for a frame is used to define an expansion point for a Taylor series approximation that is used to estimate the noise in the current frame.

19 Claims, 4 Drawing Sheets

OTHER PUBLICATIONS

"The Aurora Experimental Framework for the Performance Evaluations of Speech Recognition Systems Under Noisy Conditions," David Pearce, et al., Proc. ISCA IIRW ASR 2000, Sep. 2000.
"Efficient On–Line Acoustic Environment Estimation for FCDCN in a Continuous Speech Recognition System," Jasha Droppo, et al., ICASSP, 2001.
"Robust Automatic Speech Recognition With Missing and Unreliable Acoustic Data," Martin Cooke, Speech Communication, vol. 34, No. 3, pp267–285, Jun. 2001.
"Learning Dynamic Noise Models From Noisy Speech for Robust Speech Recognition," Brendan J. Frey, et al., Neural Information Processing Systems Conference, 2001, pp 1165–1121.
"Speech Denoising and Dereverberation Using Probabilistic Models," Hagai Attias, et al., Advances in NIPS, vol. 13, 2000 pp 758–764.
"Statistical–Model–Based Speech Enhancement Systems," Proc. of IEEE, vol. 80, No. 10, Oct. 1992, pp 1526.
"HMM–Based Strategies for Enhancement of Speech Signals Embedded in Nonstationary Noise," Hossein Sameti, IEEE Trans. Speech Audio Processing, vol. 6, No. 5, Sep. 1998, pp 445–455.
"Model–based Compensation of the Additive Noise for Continuous Speech Recognition," J.C. Segura, et al., Eurospeech 2001.
"Large–Vocabulary Speech Recognition Under Adverse Acoustic Environments," Li Deng, et al., Proc. ICSLP, vol. 3, 2000, pp 806–809.
"A Compact Model for Speaker–Adaptive Training," Anastasakos, T., et al., BBN Systems and Technologies, pp. 1137–1140 (undated).
"Suppression of Acoustic Noise in Speech Using Spectral Subtraction," Boll, S. F., IEEE Transactions on Acoustics, Speech and Signal Processing, vol. ASSP–27, No. 2, pp. 113–120 (Apr. 1979).
"Experiments With a Nonlinear Spectral Subtractor (NSS), Hidden Markov Models and the Projection, for Robust Speech Recognition in Cars," Lockwood, P. et al., Speech Communication 11, pp. 215–228 (1992).

"A Spectral Subtraction Algorithm for Suppression of Acoustic Noise in Speech," Boll, S.F., IEEE International Conference on Acoustics, Speech & Signal Processing, pp. 200–203 (Apr. 2–4, 1979).

"Enhancement of Speech Corrupted by Acoustic Noise," Berouti, M. et al., IEEE International Conference on Acoustics, Speech & Signal Processing, pp. 208–211 (Apr. 2–4, 1979).

"Acoustical and Environmental Robustness in Automatic Speech Recognition," Acero, A., Department of Electrical and Computer Engineering, Carnegie Mellon University, pp. 1–141 (Sep. 13, 1990).

"Speech Recognition in Noisy Environments," Pedro J. Moreno, Ph.D thesis, Carnegie Mellon University, 1996.

"A New Method for Speech Denoising and Robust Speech Recognition Using Probabilistic Models for Clean Speech and for Noise," Hagai Attias, et al., Proc. Eurospeech, 2001, pp 1903–1906.

Li Deng and Jeff Ma, "Spontaneous speech recognition using a statistical coarticulatory model for the vocal–tract–resonance dynamics," J. Acoust. Soc. Am. 108(5), Pt. 1, Nov. 2002.

Jeff Ma and Li Deng, "A path–stack algorithm for optimizing dynamic regimes in a statistical hidden dynamic model of speech," *Computer Speech and Language 2000*, 00, 1–14.

* cited by examiner

METHOD OF ITERATIVE NOISE ESTIMATION IN A RECURSIVE FRAMEWORK

BACKGROUND OF THE INVENTION

The present invention relates to noise estimation. In particular, the present invention relates to estimating noise in signals used in pattern recognition.

A pattern recognition system, such as a speech recognition system, takes an input signal and attempts to decode the signal to find a pattern represented by the signal. For example, in a speech recognition system, a speech signal (often referred to as a test signal) is received by the recognition system and is decoded to identify a string of words represented by the speech signal.

Input signals are typically corrupted by some form of noise. To improve the performance of the pattern recognition system, it is often desirable to estimate the noise in the noisy signal.

In the past, two general frameworks have been used to estimate the noise in a signal. In one framework, batch algorithms are used that estimate the noise in each frame of the input signal independent of the noise found in other frames in the signal. The individual noise estimates are then averaged together to form a consensus noise value for all of the frames. In the second framework, a recursive algorithm is used that estimates the noise in the current frame based on noise estimates for one or more previous or successive frames. Such recursive techniques allow for the noise to change slowly over time.

In one recursive technique, a noisy signal is assumed to be a non-linear function of a clean signal and a noise signal. To aid in computation, this non-linear function is often approximated by a truncated Taylor series expansion, which is calculated about some expansion point. In general, the Taylor series expansion provides its best estimates of the function at the expansion point. Thus, the Taylor series approximation is only as good as the selection of the expansion point. Under the prior art, however, the expansion point for the Taylor series was not optimized for each frame. As a result, the noise estimate produced by the recursive algorithms has been less than ideal.

In light of this, a noise estimation technique is needed that is more effective at estimating noise in pattern signals.

SUMMARY OF THE INVENTION

A method and apparatus estimate additive noise in a noisy signal using an iterative technique within a recursive framework. In particular, the noisy signal is divided into frames and the noise in each frame is determined based on the noise in another frame and the noise determined in a previous iteration for the current frame. In one particular embodiment, the noise found in a previous iteration for a frame is used to define an expansion point for a Taylor series approximation that is used to estimate the noise in the current frame.

DETAILED DESCRIPTION OF ILLUSTRATIVE EMBODIMENTS

Figure 1:
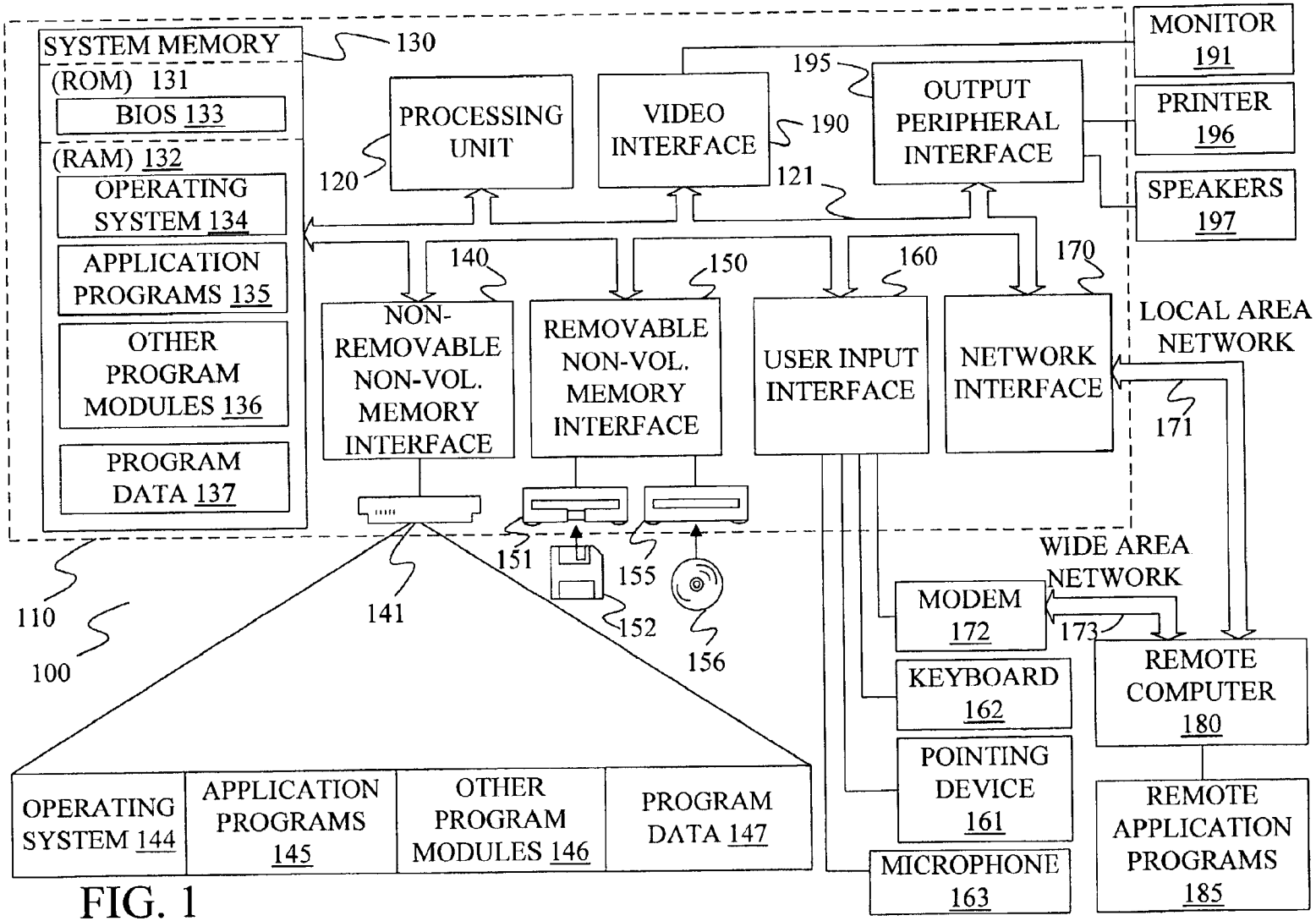
FIG. 1 is a block diagram of one computing environment in which the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VES) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
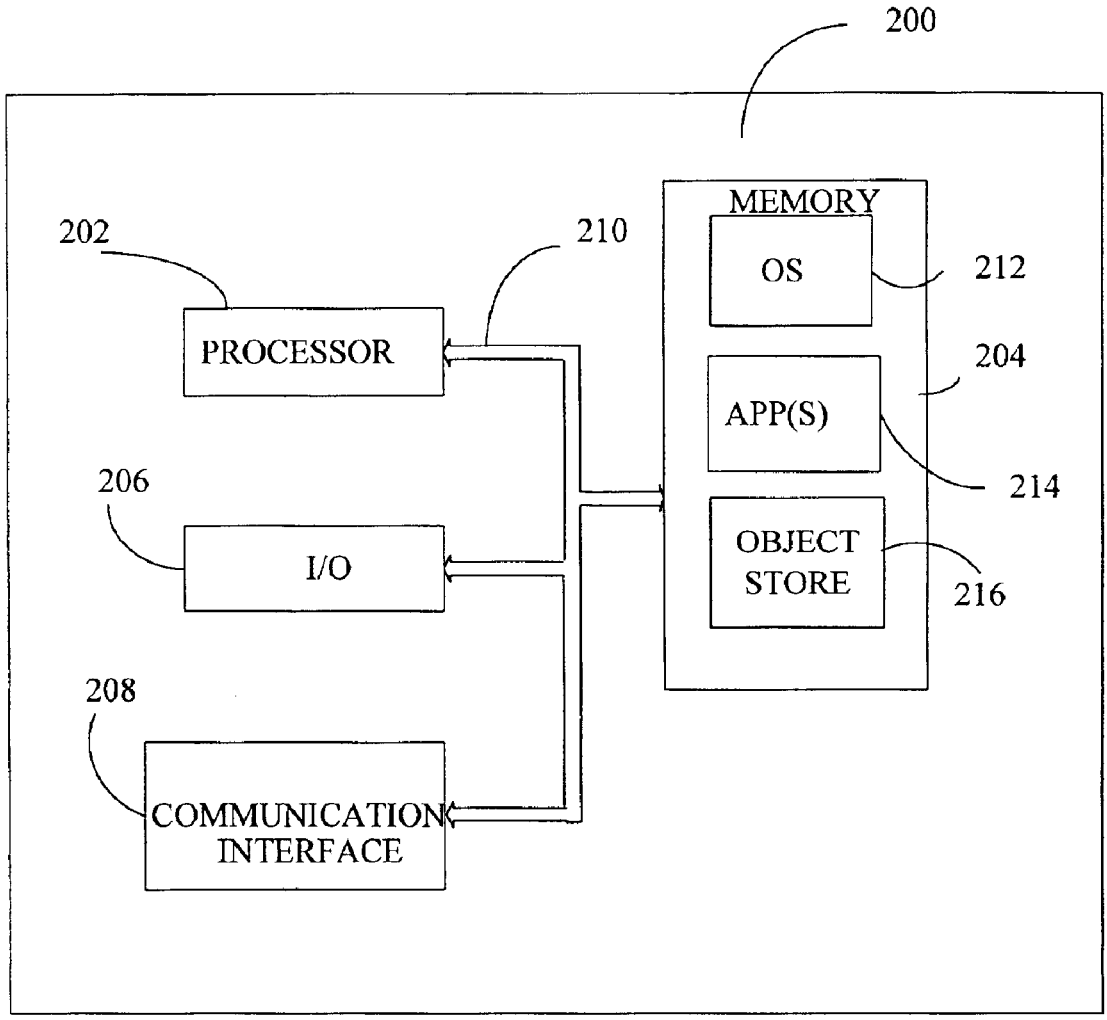
FIG. 2 is a block diagram of an alternative computing environment in which the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Under one aspect of the present invention, a system and method are provided that estimate noise in pattern recognition signals. To do this, the present invention uses a recursive algorithm to estimate the noise at each frame of a noisy signal based in part on a noise estimate found for at least one neighboring frame. Under the present invention, the noise estimate for a single frame is iteratively determined with the noise estimate determined in the last iteration being used in the calculation of the noise estimate for the next iteration. Through this iterative process, the noise estimate improves with each iteration resulting in a better noise estimate for each frame.

In one embodiment, the noise estimate is calculated using a recursive formula that is based on a non-linear relationship between noise, a clean signal and a noisy signal of:

$$y \approx x + C\mathbf{1}n(I + \exp[C^T(n-x)]) \quad \text{EQ. 1}$$

where y is a vector in the cepstra domain representing a frame of a noisy signal, x is a vector representing a frame of a clean signal in the same cepstral domain, n is a vector representing noise in a frame of a noisy signal also in the same cepstral domain, C is a discrete cosine transform matrix, and I is the identity matrix.

To simplify the notation, a vector function is defined as:

$$g(z) = C\mathbf{1}n(I + \exp[C^T z]) \quad \text{EQ. 2}$$

To improve tractability when using Equation 1, the non-linear portion of Equation 1 is approximated using a Taylor series expansion truncated up to the linear terms, with an expansion point $\mu_0^x, n_0$. This results in:

$$y = x + g(n_0 - \mu_0^x) + G(n_0 - \mu_0^x)(x - \mu_0^x) + [I - G(n_0 - \mu_0^x)](n - n_0) \quad \text{EQ. 3}$$

where G is the gradient of g(z) and is computed as:

$$G(z) = C\,diag\left(\frac{1}{1 + \exp[C^T z]}\right)C^T \quad \text{EQ. 4}$$

The recursive formula used to select the noise estimate for a frame of a noisy signal is then determined as the solution to a recursive-Expectation-Maximization optimization problem. This results in a recursive noise estimation equation of:

$$n_{t+1} = n_t + K_{t+1}^{-1} s_{t+1} \quad \text{EQ. 5}$$

where $n_t$ is a noise estimate of a past frame, $n_{t+1}$ is a noise estimate of a current frame and $s_{t+1}$ and $K_{t+1}$ are defined as:

$$s_{t+1} = \sum_{m=1}^{M} \gamma_{t+1}(m)[I - G(n_0 - \mu_0^x)]^T (\Sigma_m^y)^{-1} [y_{t+1} - \mu_m^y(n_{t+1})] \quad \text{EQ. 6}$$

$$K_{t+1} = \epsilon \cdot K_t - L_{t+1} \quad \text{EQ. 7}$$

where $$L_{t+1} = \sum_{m=1}^{M} \gamma_{t+1}(m)[I - G(n_0 - \mu_0^x)]^T (\Sigma_m^y)^{-1} [I - G(n_0 - \mu_0^x)] \quad \text{EQ. 8}$$

$$\gamma_{t+1}(m) = p(m | y_{t+1}, n_t) \quad \text{EQ. 9}$$

and where $\epsilon$ is a forgetting factor that controls the degree to which the noise estimate of the current frame is based on a past frame, $\mu_m^y$ is the mean of a distribution of noisy feature vectors, y, for a mixture component m and $$\Sigma_m^y$$

is a covariance matrix for the noisy feature vectors y of mixture component m. Using the relationship of Equation 3, $\mu_m^y$ and $$\Sigma_m^y$$

can be shown to relate to other variables according to:

$$\mu_m^y = \mu_m^x + g(n_0 - \mu_0^x) + G(n_0 - \mu_0^x)(\mu_m^x - \mu_0^x) + [I - G(n_0 - \mu_0^x)](n - n_0) \quad \text{EQ. 10}$$

$$\Sigma_m^y = [I + G(n_0 - \mu_0^x)]\Sigma_m^x [I + G^T(n_0 - \mu_0^x)]^T \quad \text{EQ. 11}$$

where $\mu_m^x$ is the mean of a Gaussian distribution of clean feature vectors x for mixture component m and $$\Sigma_m^x$$

is a covariance matrix for the distribution of clean feature vectors x of mixture component m. Under one embodiment, $\mu_m^x$ and $$\Sigma_m^x$$

for each mixture component m are determined from a set of clean input training feature vectors that are grouped into mixture components using one of any number of known techniques such as a maximum likelihood training technique.

Figure 3:
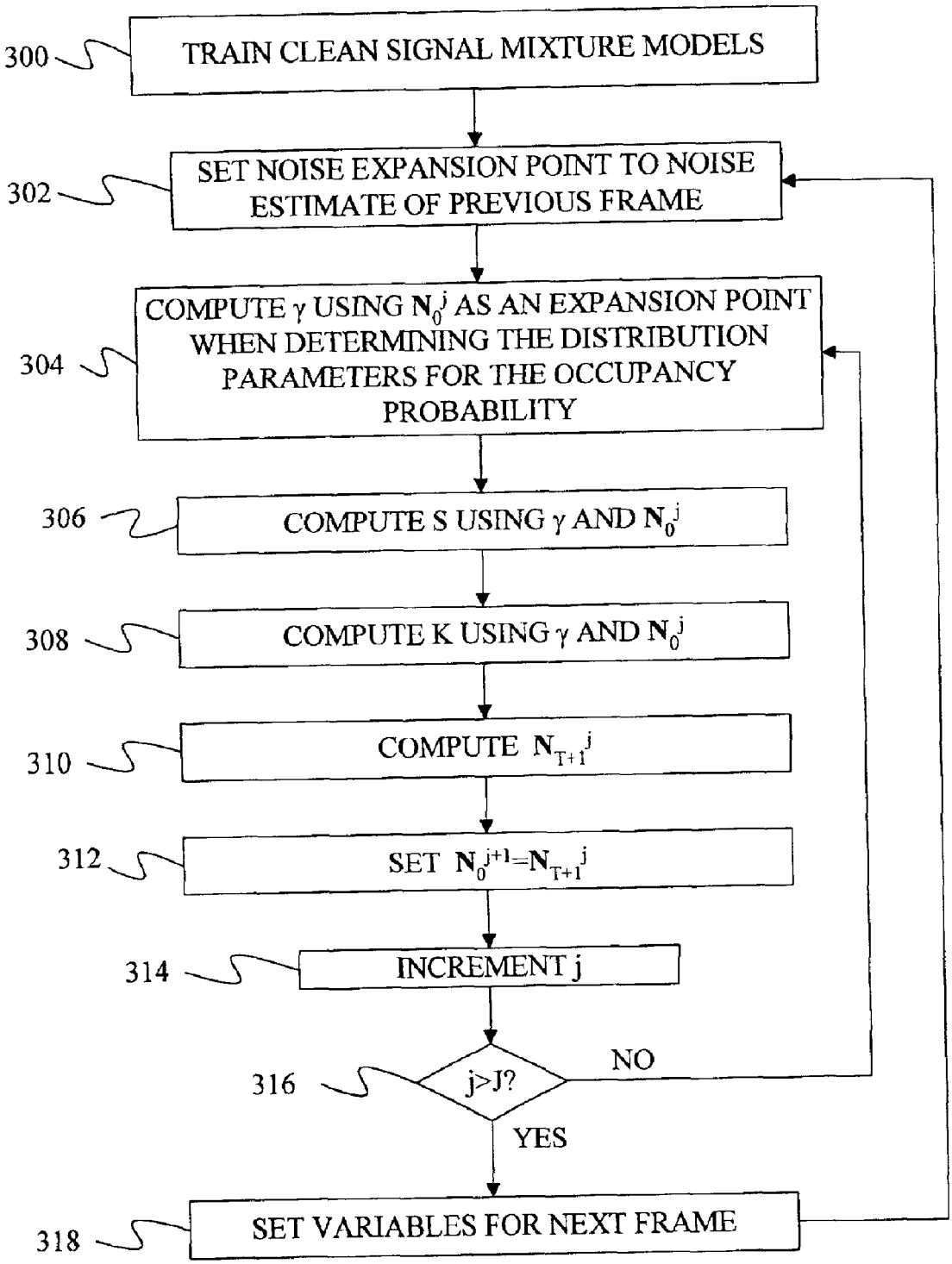
FIG. 3 is a flow diagram of a method of estimating noise under one embodiment of the present invention.

Under the present invention, the noise estimate of the current frame, $n_{t+1}$, is calculated several times using an iterative method shown in the flow diagram of FIG. 3.

The method of FIG. 3 begins at step 300 where the distribution parameters for the clean signal mixture model are determined from a set of clean training data. In particular, the mean, $\mu_m^x$, covariance, $\Sigma_m^x$, and mixture weight, $c_m$, for each mixture component m in a set of M mixture components is determined.

At step 302, the expansion point, $n_0^j$, used in the Taylor series approximation for the current iteration, j, is set equal to the noise estimate found for the previous frame. In terms of an equation:

$$n_0^j = n_t \quad \text{EQ. 12}$$

Equation 12 is based on the assumption that the noise does not change much between frames. Thus, a good beginning estimate for the noise of the current frame is the noise found in the previous frame.

At step 304, the expansion point for the current iteration is used to calculate $\gamma_{t+1}^j$. In particular, $\gamma_{t+1}^j(m)$ is calculated as:

$$\gamma_{t+1}^j(m) = \frac{p(y_{t+1} \mid m, n_t)c_m}{\sum_{m=1}^{M} p(y_{t+1} \mid m, n_t)c_m} \quad \text{EQ. 13}$$

where $p(y_{t+1}|m,n_t)$ is determined as $$p(y_{t+1} \mid m, n_t) = N[y_{t+1}; \mu_m^y(n), \Sigma_m^y] \quad \text{EQ. 14}$$

with $$\mu_m^y = \mu_m^x + g(n_0^j - \mu_0^x) + G(n_0^j - \mu_0^x)(\mu_m^x - \mu_0^x) + [I - G(n_0^j - \mu_0^x)](n_t - n_0) \quad \text{EQ. 15}$$

$$\Sigma_m^y = [I + G(n_0^j - \mu_0^x)]\Sigma_m^x[I + G^T(n_0^j - \mu_0^x)]^T \quad \text{EQ. 16}$$

After $\gamma_{t+1}^j(m)$ has been calculated, $S_{t+1}^j$ is calculated at step 306 using:

$$s_{t+1} = \sum_{m=1}^{M} \gamma_{t+1}(m)[1 - G(n_0^j - \mu_m^x)]^T (\Sigma_m^y)^{-1}[y_{t+1} - \mu_m^x - g(n_0^j - \mu_m^x)] \quad \text{EQ. 17}$$

and $K_{t+1}^j$ is calculated at step 308 using:

$$K_{t+1}^j = \varepsilon K_t^j - \sum_{m=1}^{M} \gamma_{t+1}(m)[I - G(n_0^j - \mu_0^x)]^T (\Sigma_m^y)^{-1}[I - G(n_0^j - \mu_0^x)] \quad \text{EQ. 18}$$

Once $s_{t+1}^j$ and $K_{t+1}^j$ have been determined, the noise estimate for the current frame and iteration is determined at step 310 as:

$$n_{t+1}^j = n_t + \alpha \cdot [K_{t+1}^j]^{-1} s_{t+1}^j \quad \text{EQ. 19}$$

where $\alpha$ is an adjustable parameter that controls the update rate for the noise estimate. In one embodiment $\alpha$ is set to be inversely proportional to a crude estimate of the noise variance for each separate test utterance.

At step 312, the Taylor series expansion point for the next iteration, $n_0^{j+1}$, is set equal to the noise estimate found for the current iteration, $n_{t+1}^j$. In terms of an equation:

$$n_0^{j+1} = n_{t+1}^j \quad \text{EQ. 20}$$

The updating step shown in equation 20 improves the estimate provided by the Taylor series expansion and thus improves the calculation of $\gamma_{t+1}^j(m)$, $s_{t+1}^j$ and $K_{t+1}^j$ during the next iteration.

At step 314, the iteration counter j is incremented before being compared to a set number of iterations J at step 316. If the iteration counter is less than the set number of iterations, more iterations are to be performed and the process returns to step 304 to repeat steps 304, 30, 308, 310, 312, 314, and 316 using the newly updated expansion point.

After J iterations have been performed at step 316, the final value for the noise estimate of the current frame has been determined and at step 318, the variables for the next frame are set. Specifically, the iteration counter j is set to zero, the frame value t is incremented by one, and the expansion point $n_0$ for the first iteration of the next frame is set to equal to the noise estimate of the current frame.

The noise estimation technique described above may be used in a noise normalization technique such as the technique discussed in a patent application entitled METHOD OF NOISE REDUCTION USING CORRECTION VECTORS BASED ON DYNAMIC ASPECTS OF SPEECH AND NOISE NORMALIZATION, Ser. No. 10/117,142, and filed on even date herewith. The invention may also be used more directly as part of a noise reduction system in which the estimated noise identified for each frame is removed from the noisy signal to produce a clean signal.

Figure 4:
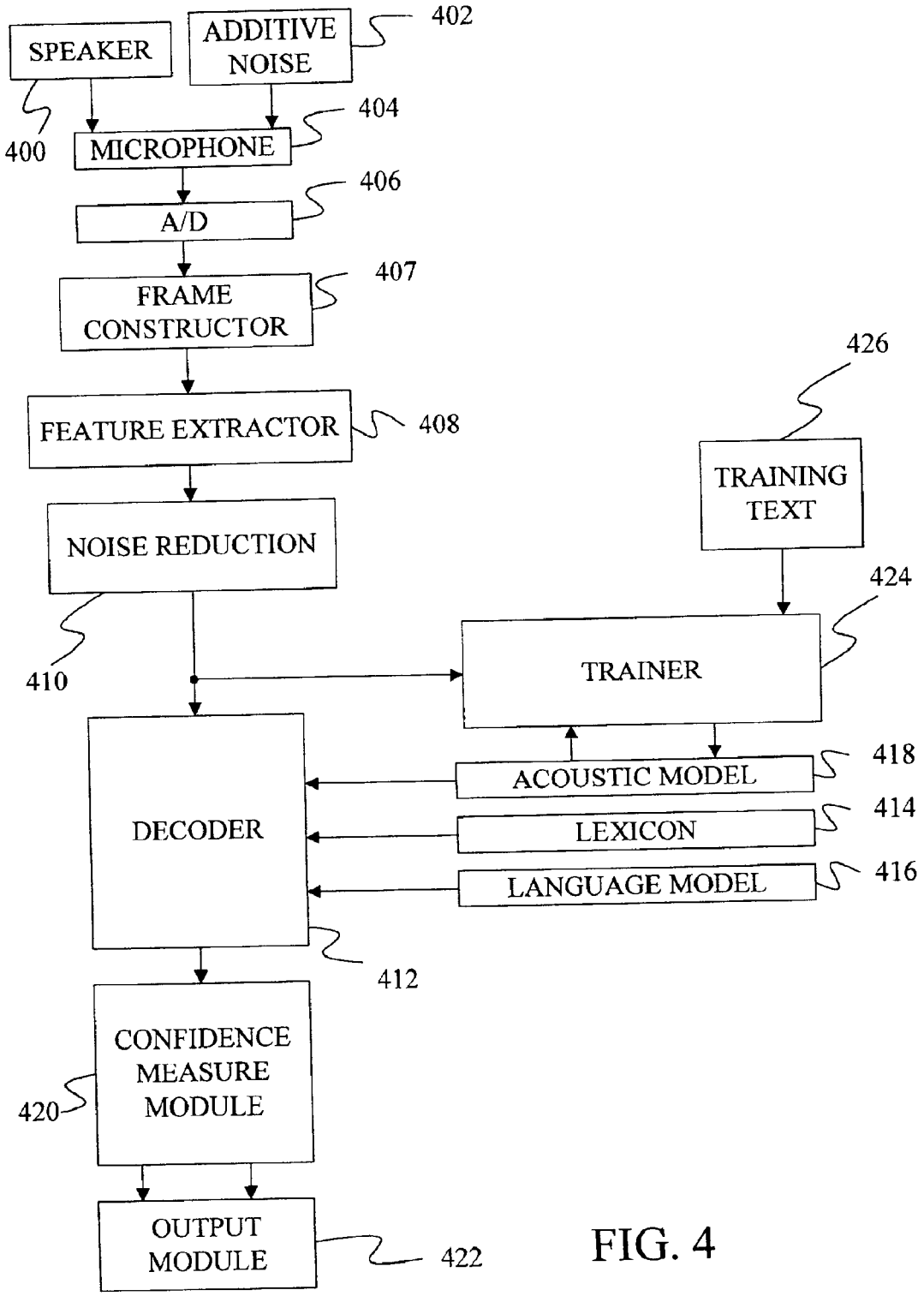
FIG. 4 is a block diagram of a pattern recognition system in which the present invention may be used.

FIG. 4 provides a block diagram of an environment in which the noise estimation technique of the present invention may be utilized to perform noise reduction. In particular, FIG. 4 shows a speech recognition system in which the noise estimation technique of the present invention can be used to reduce noise in a training signal used to train an acoustic model and/or to reduce noise in a test signal that is applied against an acoustic model to identify the linguistic content of the test signal.

In FIG. 4, a speaker 400, either a trainer or a user, speaks into a microphone 404. Microphone 404 also receives additive noise from one or more noise sources 402. The audio signals detected by microphone 404 are converted into electrical signals that are provided to analog-to-digital converter 406.

Although additive noise 402 is shown entering through microphone 404 in the embodiment of FIG. 4, in other embodiments, additive noise 402 may be added to the input speech signal as a digital signal after A-to-D converter 406.

A-to-D converter 406 converts the analog signal from microphone 404 into a series of digital values. In several embodiments, A-to-D converter 406 samples the analog signal at 16 kHz and 16 bits per sample, thereby creating 32 kilobytes of speech data per second. These digital values are provided to a frame constructor 407, which, in one embodiment, groups the values into 25 millisecond frames that start 10 milliseconds apart.

The frames of data created by frame constructor 407 are provided to feature extractor 408, which extracts a feature from each frame. Examples of feature extraction modules include modules for performing Linear Predictive Coding (LPC), LPC derived cepstrum, Perceptive Linear Prediction (PLP), Auditory model feature extraction, and Mel-Frequency Cepstrum Coefficients (MFCC) feature extraction. Note that the invention is not limited to these feature extraction modules and that other modules may be used within the context of the present invention.

The feature extraction module produces a stream of feature vectors that are each associated with a frame of the speech signal. This stream of feature vectors is provided to noise reduction module 410, which uses the noise estimation technique of the present invention to estimate the noise in each frame.

The output of noise reduction module 410 is a series of "clean" feature vectors. If the input signal is a training signal, this series of "clean" feature vectors is provided to a trainer 424, which uses the "clean" feature vectors and a training text 426 to train an acoustic model 418. Techniques for training such models are known in the art and a description of them is not required for an understanding of the present invention.

If the input signal is a test signal, the "clean" feature vectors are provided to a decoder 412, which identifies a most likely sequence of words based on the stream of feature vectors, a lexicon 414, a language model 416, and the acoustic model 418. The particular method used for decoding is not important to the present invention and any of several known methods for decoding may be used.

The most probable sequence of hypothesis words is provided to a confidence measure module 420. Confidence measure module 420 identifies which words are most likely to have been improperly identified by the speech recognizer, based in part on a secondary acoustic model (not shown). Confidence measure module 420 then provides the sequence of hypothesis words to an output module 422 along with identifiers indicating which words may have been improperly identified. Those skilled in the art will recognize that confidence measure module 420 is not necessary for the practice of the present invention.

Although FIG. 4 depicts a speech recognition system, the present invention may be used in any pattern recognition system and is not limited to speech.

Although the present invention has been described with reference to particular embodiments, workers skilled in the art will recognize that changes may be made in form and detail without departing from the spirit and scope of the invention.

What is claimed is:

1. A method for estimating noise in a noisy signal, the method comprising:

dividing the noisy signal into frames;

determining a noise estimate for a first frame of the noisy signal;

determining a noise estimate for a second frame of the noisy signal based in part on the noise estimate for the first frame; and using the noise estimate for the second frame and the noise estimate for the first frame to determine a second noise estimate for the second frame.

2. The method of claim 1 wherein using the noise estimate for the second frame and the noise estimate for the first frame comprises using the noise estimate for the second frame and the noise estimate for the first frame in an update equation that is the solution to a recursive Expectation-Maximization optimization problem.

3. The method of claim 2 wherein the update equation is based in part on a definition of the noisy signal as a non-linear function of a clean signal and a noise signal.

4. The method of claim 3 wherein the update equation is further based on an approximation to the non-linear function.

5. The method of claim 4 wherein the approximation equals the non-linear function at a point defined in part by the noise estimate for the second frame.

6. The method of claim 5 wherein the approximation is a Taylor series expansion.

7. The method of claim 1 wherein using the noise estimate for the second frame comprises using the noise estimate for the second frame as an expansion point for a Taylor series expansion of a non-linear function.

8. A computer-readable medium having computer-executable instructions for performing steps comprising:

dividing a noisy signal into frames; and iteratively estimating the noise in each frame such that in at least one iteration for a current frame the estimated noise is based on a noise estimate for at least one other frame and a noise estimate for the current frame produced in a previous iteration.

9. The computer-readable medium of claim 8 wherein iteratively estimating the noise in a frame comprises using the noise estimate for the current frame produced in a previous iteration to evaluate at least one function.

10. The computer-readable medium of claim 9 wherein the at least one function is based on an assumption that a noisy signal has a non-linear relationship to a clean signal and a noise signal.

11. The computer-readable medium of claim 10 wherein the function is based on an approximation to the non-linear relationship between the noisy signal the clean signal and the noise signal.

12. The computer-readable medium of claim 11 wherein the approximation is a Taylor series approximation.

13. The computer-readable medium of claim 12 wherein the noise estimate for the current frame produced in a previous iteration is used to select an expansion point for the Taylor series expansion.

14. The computer-readable medium of claim 8 wherein iteratively estimating the noise in each frame comprises estimating the noise using an update equation that is based on a recursive Expectation-Maximization calculation.

15. A method of estimating noise in a current frame of a noisy signal, the method comprising:

applying a previous estimate of the noise in the current frame to at least one function to generate an update value; and adding the update value to an estimate of noise in a second frame of the noisy signal to produce an estimate of the noise in the current frame.

16. The method of claim 15 wherein applying a previous estimate of the noise in the current frame comprise applying the previous estimate to a function that is based on an approximation to a non-linear function.

17. The method of claim 16 wherein the approximation is a Taylor series approximation.

18. The method of claim 17 wherein applying the previous estimate of the noise comprises using the previous estimate of the noise to define an expansion point for the Taylor series approximation.

19. The method of claim 16 wherein applying a previous estimate of the noise in the current frame to at least one function comprises applying the previous estimate to define distribution values for a distribution of noisy feature vectors in terms of distribution values for clean feature vectors.

* * * * *

UNITED STATES PATENT AND TRADEMARK OFFICE

CERTIFICATE OF CORRECTION

PATENT NO. : 6,944,590 B2
APPLICATION NO. : 10/116792
DATED : September 13, 2005
INVENTOR(S) : Deng et al.

It is certified that error appears in the above-identified patent and that said Letters Patent is hereby corrected as shown below:

On the title page, item (56), under "Other Publications", in column 1, line 2, delete "G.Droppo" and insert -- G. Droppo --, therefor.

On the title page, item (56), under "Other Publications", in column 2, line 2, delete "," before "Mohomed".

In column 2, line 49, delete "(VES)" and insert -- (VESA) --, therefor.

In column 7, line 27, after "as" insert -- : --.

In column 7, line 43–46 (EQ. 17), delete $$s_{t+1} = \sum_{m=1}^{M} \gamma_{t+1}(m)[1 - G(n_0^j - \mu_m^x)]^T$$

"

$$(\Sigma_m^y)^{-1}[y_{t+1} - \mu_m^x - g(n_0^j - \mu_m^x)]$$

" and insert $$s_{t+1} = \sum_{m=1}^{M} \gamma_{t+1}(m)\left[1 - G\left(n_0^j - \mu_m^x\right)\right]^T \left(\Sigma_m^y\right)^{-1}\left[y_{t+1} - \mu_m^x - g\left(n_0^j - \mu_m^x\right)\right]$$

-- --, therefor.

In column 8, line 13, delete "30," and insert -- 306, --, therefor.

Signed and Sealed this

Twenty-third Day of March, 2010

David J. Kappos

David J. Kappos
*Director of the United States Patent and Trademark Office*